US009243627B2

(12) United States Patent
Engelhardt

(10) Patent No.: US 9,243,627 B2
(45) Date of Patent: Jan. 26, 2016

(54) COMPRESSOR TEMPERATURE CONTROL BY INDIRECT TEMPERATURE MEASUREMENT

(75) Inventor: Marek Engelhardt, Friedewald (DE)

(73) Assignee: Continetal Teves AG & Co. oHG (DE)

( * ) Notice: Subject to any disclaimer, the term of this patent is extended or adjusted under 35 U.S.C. 154(b) by 453 days.

(21) Appl. No.: 13/634,592

(22) PCT Filed: Mar. 24, 2011

(86) PCT No.: PCT/EP2011/054529

§ 371 (c)(1),
(2), (4) Date: Sep. 13, 2012

(87) PCT Pub. No.: WO2011/117341

PCT Pub. Date: Sep. 29, 2011

(65) Prior Publication Data

US 2013/0004333 A1 Jan. 3, 2013

(30) Foreign Application Priority Data

Mar. 25, 2010 (DE) ..... 10 2010 016 131

(51) Int. Cl.

*F04B 49/02* (2006.01)
*F04B 49/06* (2006.01)
*F04B 49/10* (2006.01)

(52) U.S. Cl.

CPC ..... *F04B 49/02* (2013.01); *F04B 49/065* (2013.01); *F04B 49/10* (2013.01); *F04B 2201/0403* (2013.01); *F04B 2201/0801* (2013.01); *F04B 2203/0205* (2013.01); *F04B 2203/0405* (2013.01); *F04B 2205/065* (2013.01); *F04B 2205/10* (2013.01); *F04B 2205/11* (2013.01); *F04B 2207/03* (2013.01); *F04B 2207/042* (2013.01); *F04B 2207/043* (2013.01)

(58) Field of Classification Search

CPC ..... F04B 49/06; F04B 2201/0801; F04B 2203/0205; F04B 2205/05; F04B 2207/403; F04B 2207/03; F04B 2207/042; F04B 2205/10; F04B 2205/11; F04B 2201/0403; F04B 2207/043; F04B 2203/0405

USPC ..... 318/400.08; 374/144, 134, 120

See application file for complete search history.

(56) References Cited

U.S. PATENT DOCUMENTS

| | | | |
|---|---|---|---|
| 2,946,203 | A | 7/1960 | Carver |
| 3,874,187 | A | 4/1975 | Anderson |
| 3,877,837 | A | 4/1975 | Parker et al. |

(Continued)

FOREIGN PATENT DOCUMENTS

| | | |
|---|---|---|
| DE | 196 21 946 | 9/1997 |
| EP | 1 541 869 | 6/2005 |
| EP | 1 961 960 | 8/2008 |

OTHER PUBLICATIONS

International Search Reporting corresponding to International Application No. PCT/EP2011/054529, dated Jun. 22, 2011.

*Primary Examiner* — Bryan Lettman
*Assistant Examiner* — Timothy P Solak
(74) *Attorney, Agent, or Firm* — RatnerPrestia

(57) ABSTRACT

A method for regulating a compressor of a pressure supplying system. The compressor is switched on and off dependent on a threshold temperature of one or more components of the pressure supplying system, the threshold temperature being ascertained using a temperature calculating method. The respective threshold temperature is ascertained by correlating the reciprocal temperature dependence that exists as a result of heat transfer between adjacent components.

5 Claims, 1 Drawing Sheet

(56) References Cited

U.S. PATENT DOCUMENTS 5,106,202 A * 4/1992 Anderson et al. ..... 374/144
5,339,678 A * 8/1994 Haselmaier, Sr. ... G01M 3/2876 73/37
6,695,471 B2 * 2/2004 Hashimoto et al. ..... 374/134
7,617,031 B2 * 11/2009 Li ..... B60G 17/0155 180/337
2006/0247827 A1 * 11/2006 Fukasaku et al. ..... 700/299
2007/0098564 A1 * 5/2007 Sorge ..... F04B 49/065 417/32

* cited by examiner

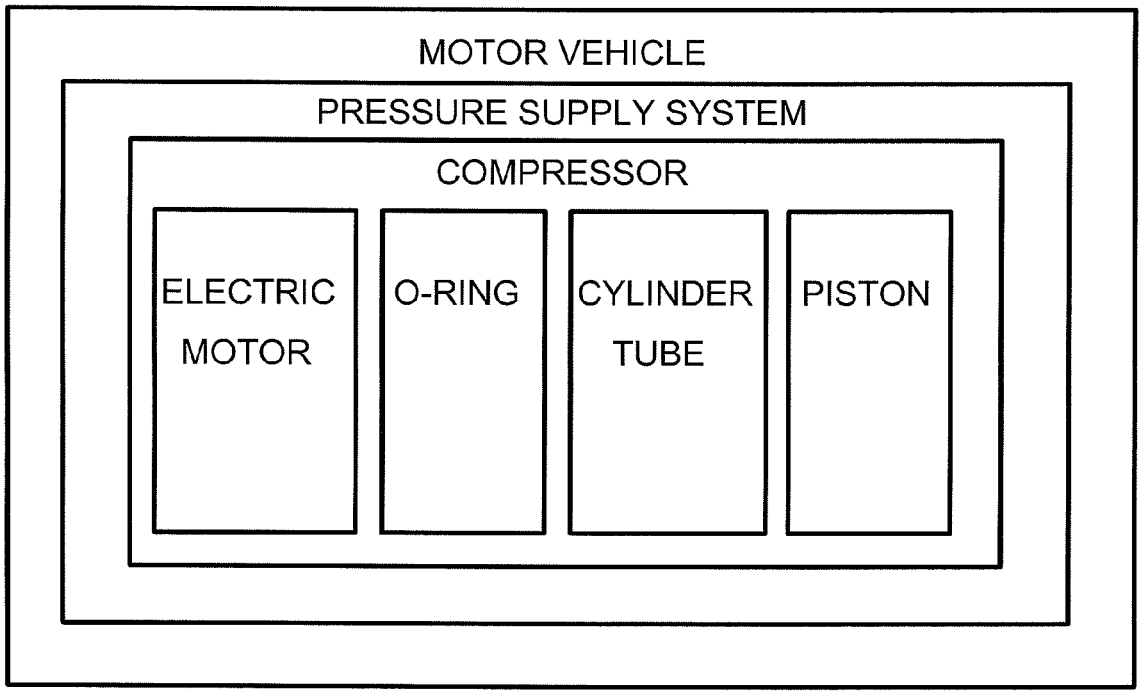
MOTOR VEHICLE
PRESSURE SUPPLY SYSTEM
COMPRESSOR
ELECTRIC MOTOR
O-RING
CYLINDER TUBE
PISTON

COMPRESSOR TEMPERATURE CONTROL BY INDIRECT TEMPERATURE MEASUREMENT

CROSS REFERENCE TO RELATED APPLICATIONS

This application is the U.S. National Phase Application of PCT International Application No. PCT/EP2011/054529, filed Mar. 24, 2011, which claims priority to German Patent Application No. 10 2010 016 131.4, filed Mar. 25, 2010, the contents of such applications being incorporated by reference herein.

FIELD OF THE INVENTION

The invention relates to a method for regulating a compressor of a pressure supply system wherein the compressor is switched on and off in dependence on a limit temperature of one or more components of the pressure supply system ascertained with the aid of a temperature calculation method.

BACKGROUND OF THE INVENTION

Such methods for controlling compressors in motor vehicles are known and are intended essentially to avoid overheating of the equipment resulting from overloading. In the case of a compressor for a vehicle with an air suspension system, for example, increased heat generation is less to be feared during normal driving, since fewer level changes normally occur in this state. However, in the case of level changes at standstill, or constant level regulation resulting from manual operation or changing load, or for fast all-terrain vehicles in off-road use or when the compressor or compressor drive is heavily encapsulated with insulation materials (sound damping), relatively severe heating is not uncommon.

In this connection DE 196 21 946 C1, which is incorporated by reference, discloses an air suspension which has a compressor working according to demand and intermittently in normal operation, which compressor is switched on and off by a control unit in dependence on an estimated temperature, the estimated temperature being calculated as the instantaneously present operating temperature. If the calculated "estimated temperature" exceeds a threshold value, the compressor is switched off. As a result, no temperature sensors for monitoring the compressor are needed and therefore no additional signal inputs for the control unit. It is disadvantageous in this case that, also and especially in the case of the abrupt increase in the "estimated value" of the compressor provided each time the compressor is switched on again, which abrupt increase is also disclosed, with rising temperature the compressor is switched on and off more and more frequently and within shorter time intervals, without reaching the desired pressure increase in the system.

In addition, the temperature limit values for switching the compressor on and off in vehicle level control systems are usually designed in such a way that, when the compressor is switched on again, a predefined level change can be carried out with a fully loaded vehicle. However, in most cases a full load is not present, whereby the availability of the compressor is unnecessarily limited.

SUMMARY OF THE INVENTION

It was therefore an aspect of the invention to provide a method in which overloading or overheating of the compressor and/or of the compressor drive is avoided and the availability of the compressor is increased, and in which the necessary changes of the air quantities in the system are successfully carried out in all operating states.

BRIEF DESCRIPTION OF THE DRAWING FIGURE

The sole FIGURE depicts a block diagram of a motor vehicle having a pressure supply system including a compressor.

DETAILED DESCRIPTION OF THE PREFERRED EMBODIMENTS

In this case the respective limit temperature for switching on or off, that is, the switch-on or switch-off temperature of the compressor, is ascertained using the temperature calculation method in dependence on one or more of the parameters: system pressure, ambient temperature and running time of the compressor, the temperature of the component being ascertained by correlating the reciprocal temperature dependence existing through heat transfer between adjacent components.

Heat transfer is understood to mean both heat dissipation and heat addition, which may occur in this case through radiation, convection or heat transmission, for example. Correlation in this case means that the influence of the temperature increase of the component considered resulting from reciprocal heat transfer between adjacent components, or the influence of the temperature reduction of the component considered resulting from reciprocal heat dissipation between adjacent components, is included in the calculation of the temperature of that component.

Whereas it has hitherto been the practice to take account only of individual component-dependent switch-off temperatures of a compressor, which switch-off temperatures were calculated using mathematical models in a control unit of a vehicle operating with an air suspension system, the further development of materials and components and the change in the conditions of use make it necessary to define a switch-off temperature for more than just one critical component.

For example, in the past the switch-off temperature of 180° C. used hitherto was sufficient to protect the sleeve of the compressor piston. The lengthening of the compressor running time until the switch-off temperature of 200° C. is reached, necessary for some vehicles, makes it necessary to redefine a switch-off temperature while taking account of further critical components of the electric motor and while taking account of the sealing material.

Thus, whereas in the previous configurations of the compressor only one switch-off temperature for protecting the compressor from thermal damage was taken into account, for example for a closed level control system, the use of new components makes it necessary also to take account of the temperatures of further components of the compressor, such as the temperature of the brush holders of the electric motor provided as the drive, the temperature of a sleeve arranged on the compressor piston, or the temperature of the cylinder tube, in order not to damage the compressor prematurely.

The switch-off temperatures of 180° C. and 200° C. are mentioned here as numerical values by way of example. Depending on the construction and planned availability of the compressor, these values may fluctuate and, in the case of compressors for air suspensions of heavy goods vehicles, are often higher, namely between 220° C. and 250° C.

The compressor is therefore advantageously switched on and off in dependence on the limit temperature of a piston sleeve of the compressor piston, the temperature of the piston sleeve being ascertained by correlating the reciprocal temperature dependence existing as a result of heat transfer between the cylinder tube of the compressor and the piston sleeve.

However, if the maximum limit temperature is increased, for example by 20K, it is found that under these conditions the component to be protected, that is, the critical component, is not the sleeve but the O-rings which seal the compressor unit at various points. The compressor is then advantageously switched on and off in dependence on the limit temperature of an O-ring of the compressor piston, the temperature of the O-ring being ascertained by correlating the reciprocal temperature dependence existing as a result of heat transfer between the cylinder tube of the compressor and the O-ring.

In the test series conducted in relation to the invention, various O-rings had to be exchanged frequently. It was noticeable that the O-rings always failed if the cylinder tube temperature was above a temperature of 160° C. for a certain time. In developing the previous temperature model it was seen, surprisingly, that with a suitable correlation of the temperatures of individual components which influence one another reciprocally through heat transfer, for example by radiation, convection or heat transmission, a temperature for the cylinder head interior $T_{ZKI}$ which not only prevented damaging overheating of the sleeve made, for example, of PTFE (polytetrafluoroethylene), but also, at the same time, produced a temperature for the cylinder tube $T_{ZR}$ in order to protect the thermally highly-stressed O-ring against temperature failure.

This is because the mathematical description of the model shows a "fully coupled" dependence between the two temperatures to be calculated. This also means that the temperatures to be calculated instantaneously at time k depend on the temperatures which were calculated previously at time k−1.

$$T_{ZKI,\,k}=f(T_{ZKI,\,k-1},\,T_{ZR,\,k-1})$$

$$T_{ZR,\,k}=f(T_{ZKI,\,k-1},\,T_{ZR,\,k-1})$$

In this case, if a previously defined limit value for temperature is reached, that is, a "switch-off temperature" for a particular component, the compressor is switched off so that the component can cool down again.

The brush holder of an electric motor of a compressor is now also a "temperature-critical" component, since plastics material is now used at this location. The component carrying the carbon brushes, which are pressed by means of a spring against the rotor of an electric motor as a sliding contact, is referred to as a brush holder or brush yoke.

Consequently a further critical switch-off temperature, which must be predefined and stored as a limit value, must also be provided in relation to this component or to the electric motor, running of the compressor being interrupted upon attainment of this temperature during operation of the compressor. A further advantageous configuration therefore consists in switching a compressor driven by an electric motor on and off in dependence on the limit temperature of the brush holder of the electric motor, the temperature of the brush holder being ascertained by correlating the reciprocal temperature dependence existing as a result of heat transfer between the cylinder tube of the compressor and the brush holder.

With such a method a simple optimization of the operation of the compressor can be carried out, so that after the compressor has been switched off and the "triggering" component has subsequently cooled, which cooling can also be calculated in dependence on the heat transfer between the individual components, the compressor is again available as quickly as possible for a function now to be performed.

An advantageous development consists in estimating the critical limit temperature of the component with reference to characteristic curves—or also with reference to mathematical models. This simplifies adaptation to different operating conditions, such as full load or minimum load of a vehicle.

A further advantageous development consists in defining the critical limit temperature of the component in dependence on the instantaneous driving state. In special situations a higher limit temperature can thereby be set for a short period for special functions. Such a higher limit temperature may be necessary if scope should be left for a further "temperature reserve". A typical case is, for example, automatic level control processes which have higher priority than manual control processes.

The invention claimed is:

1. A method for regulating a compressor of a pressure supply system for a motor vehicle, wherein the compressor is driven by an electric motor and switched on and off in dependence on a limit temperature of one or more components of the pressure supply system ascertained with the aid of a temperature calculation method, wherein said limit temperature for switching the compressor on or off is ascertained using the temperature calculation method in dependence on one or more of the parameters: system pressure, ambient temperature, and running time of the compressor, the temperature of the component being ascertained by correlating the heat transfer between the component and an adjacent component, wherein the component is an O-ring of a compressor piston, the adjacent component is a cylinder tube of the compressor, and the limit temperature of the one or more components of the pressure supply system is the limit temperature of the O-ring, wherein the compressor is switched on and off in dependence on the limit temperature of the O-ring of the compressor piston, the temperature of the O-ring being ascertained by correlating the heat transfer between the cylinder tube of the compressor and the O-ring.

2. The method as claimed in claim 1, wherein the compressor is also switched on and off in dependence on the limit temperature of a brush holder of the electric motor, the temperature of the brush holder being ascertained by correlating the heat transfer between the cylinder tube of the compressor and the brush holder.

3. The method as claimed in claim 1, wherein the compressor is also switched on and off in dependence on the limit temperature of a piston sleeve of the compressor piston, the temperature of the piston sleeve being ascertained by correlating the heat transfer between the cylinder tube of the compressor and the piston sleeve.

4. The method as claimed in claim 1, wherein the limit temperature is defined in dependence on an instantaneous driving state.

5. A method for regulating a compressor of a pressure supply system for a motor vehicle, wherein the compressor is driven by an electric motor and switched on and off in dependence on a limit temperature of one or more components of the pressure supply system ascertained with the aid of a temperature calculation method, wherein said limit temperature for switching the compressor on or off is ascertained using the temperature calculation method in dependence on one or more of the parameters: system pressure, ambient temperature, and running time of the compressor, the temperature of the component being ascertained by correlating the heat transfer between the component and an adjacent component, and wherein the compressor is switched on and off in dependence on the limit temperature of an O-ring of a compressor piston, the temperature of the O-ring being ascertained by correlating the heat transfer between a cylinder tube of the compressor and the O-ring.

* * * * *